US006196149B1

(12) United States Patent
Palm

(10) Patent No.: US 6,196,149 B1
(45) Date of Patent: Mar. 6, 2001

(54) SAIL DEVICE

(76) Inventor: Carl Palm, Apelgården, Pl. 7172, S-471 73 Hjälteby (SE)

( * ) Notice: Subject to any disclaimer, the term of this patent is extended or adjusted under 35 U.S.C. 154(b) by 0 days.

(21) Appl. No.: 09/355,416

(22) PCT Filed: Jan. 27, 1998

(86) PCT No.: PCT/SE98/00122

§ 371 Date: Jul. 27, 1999

§ 102(e) Date: Jul. 27, 1999

(87) PCT Pub. No.: WO98/32653

PCT Pub. Date: Jul. 30, 1998

(30) Foreign Application Priority Data

Jan. 27, 1997 (SE) ..... 9700216

(51) Int. Cl.[7] ..... B63H 9/04

(52) U.S. Cl. ..... 114/102.25; 114/102.24

(58) Field of Search ..... 114/102.22, 102.24, 114/102.25, 102.26, 102.27

(56) References Cited

U.S. PATENT DOCUMENTS

| | | | |
|---|---|---|---|
| 4,706,591 | 11/1987 | Renolds | 114/103 |
| 5,065,685 | 11/1991 | Stevenson, IV | 114/102 |
| 5,146,864 | 9/1992 | Harrington | 114/103 |

*Primary Examiner*—S. Joseph Morano
*Assistant Examiner*—Patrick Craig Muldoon

(57) ABSTRACT

The invention relates to an arrangement (1) an arrangement for a sail (2) enabling to form to be varied and comprising battens (4—4) extending between the fore-leech (9) and the after-leech (10). According to the invention, the form of the battens (4—4) is so arranged as to vary depending on the wind and the desired form of the sail. This can be done as the sail is divided and built of several with between the segment is located as battens effecting connectable devices which are elastic across the connection device's length extension.

15 Claims, 12 Drawing Sheets

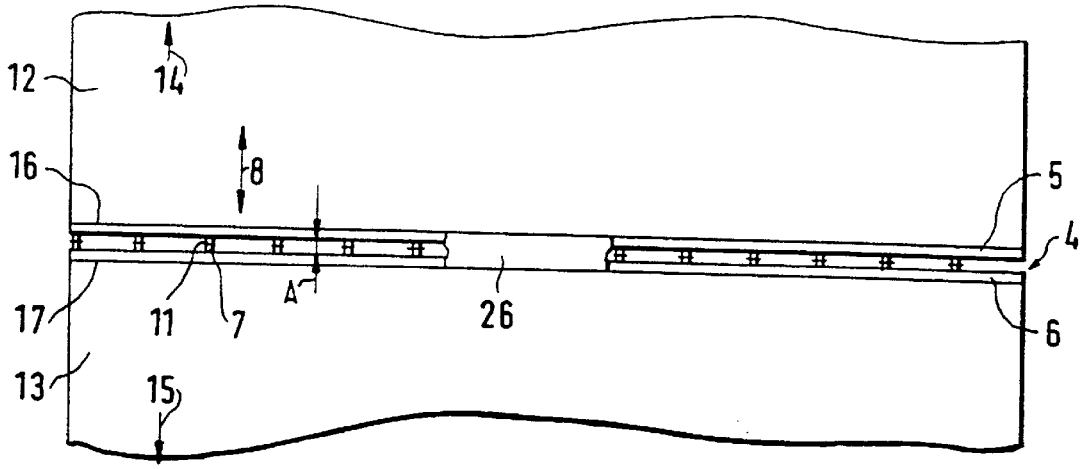
FIG. 4
FIG. 5A
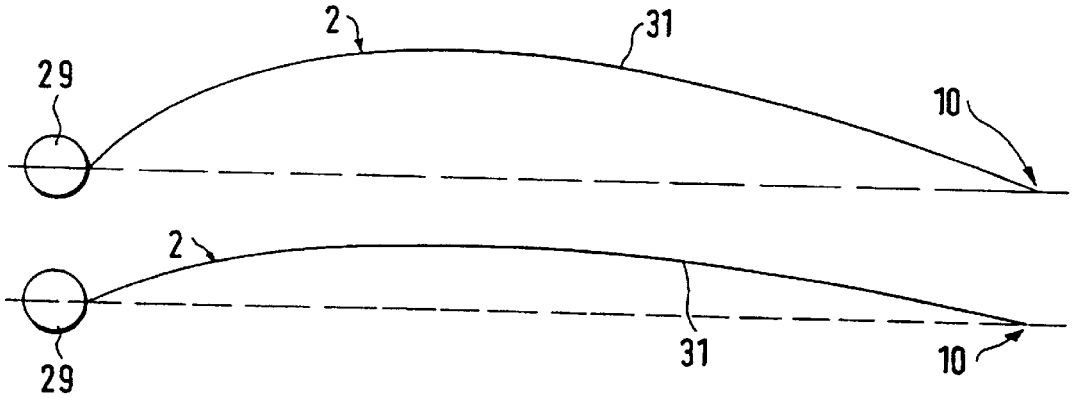
FIG. 5

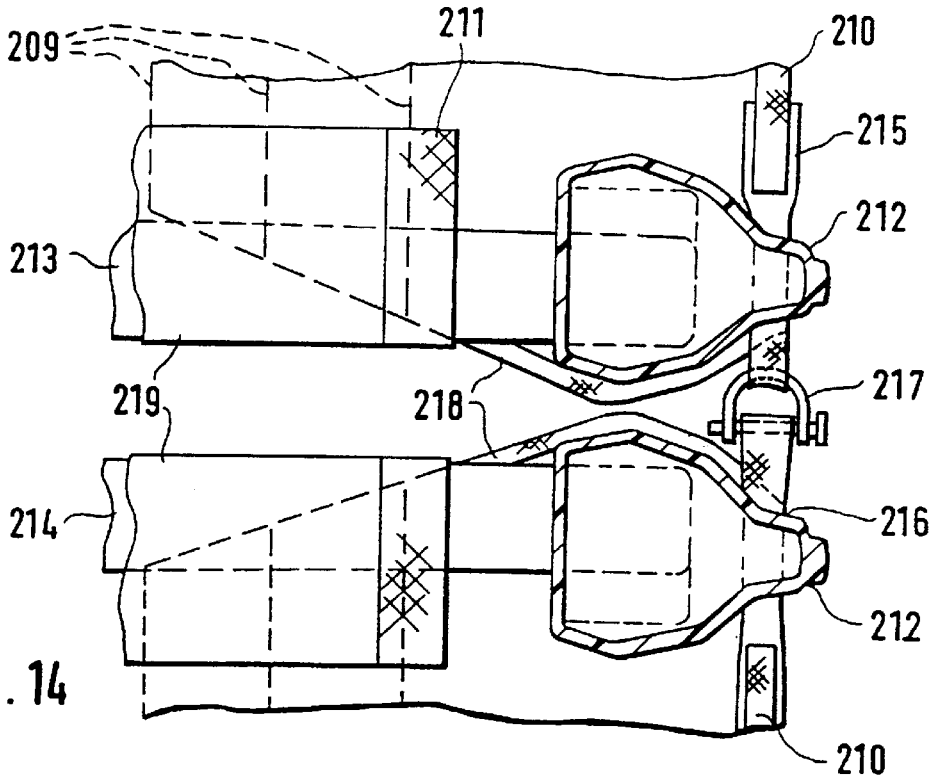
FIG. 14
FIG. 14A
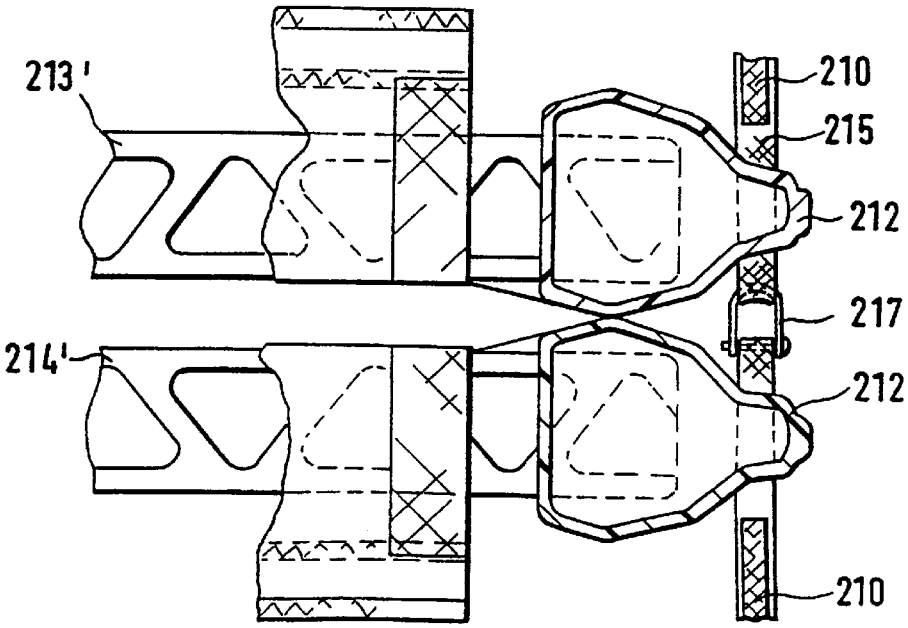

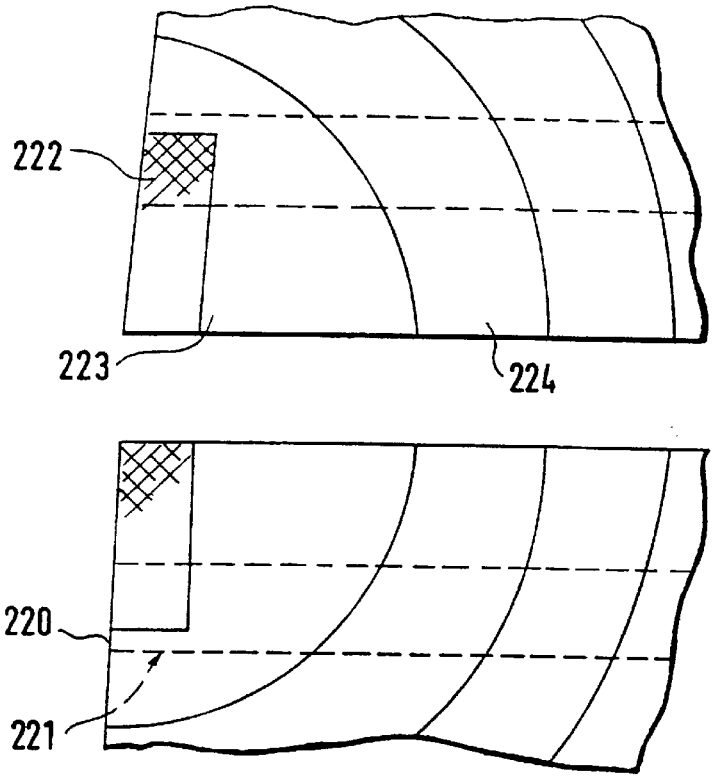
FIG.15
FIG.16
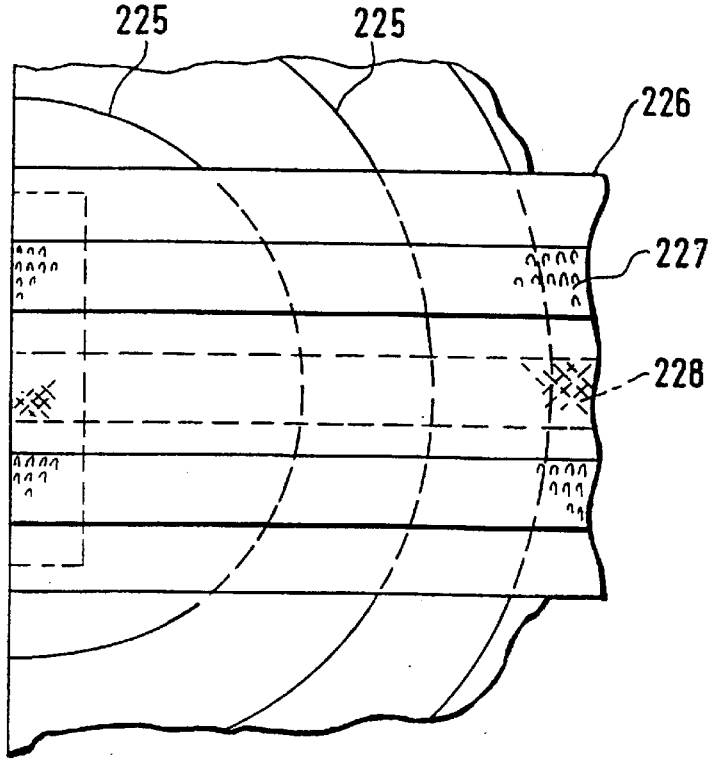

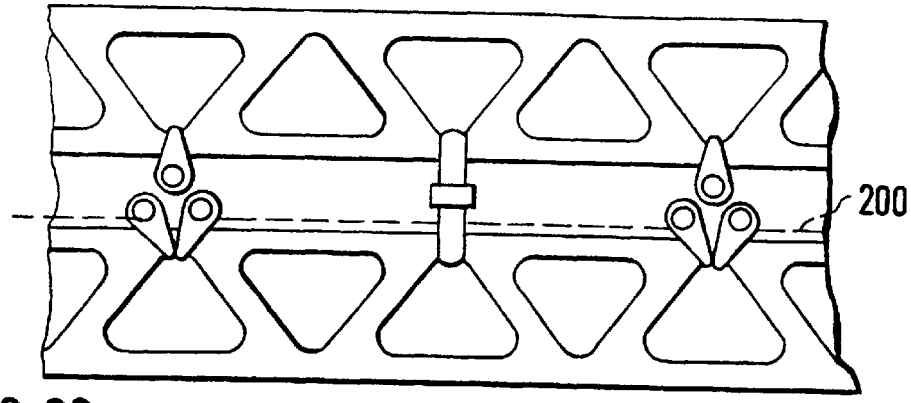
FIG.20
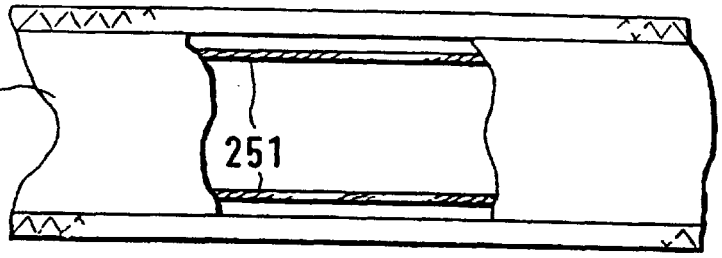
FIG.21
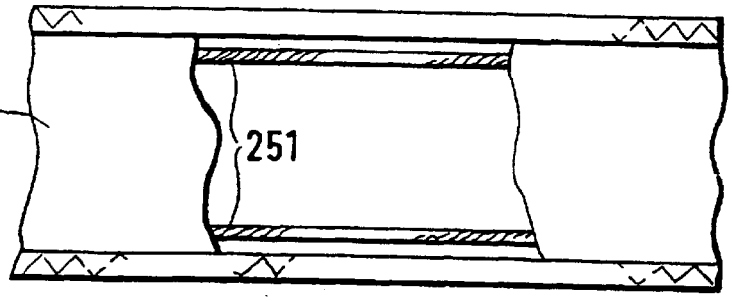
FIG.22
FIG.23
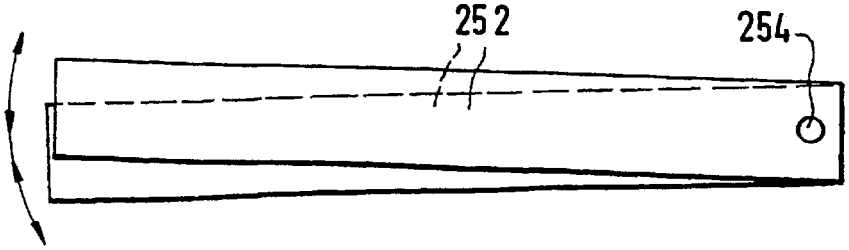

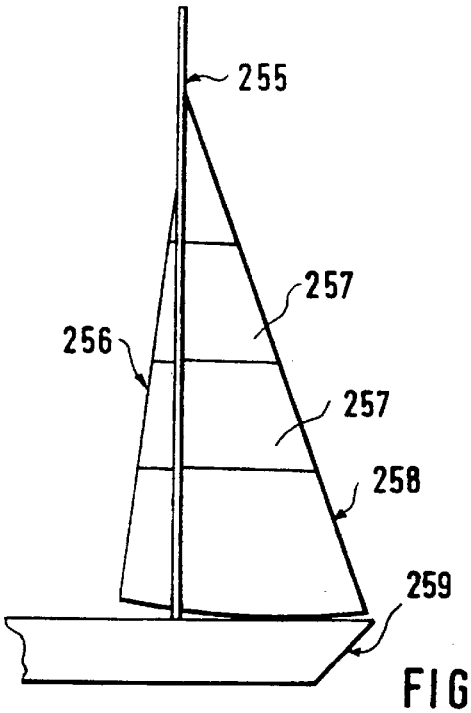
FIG.24
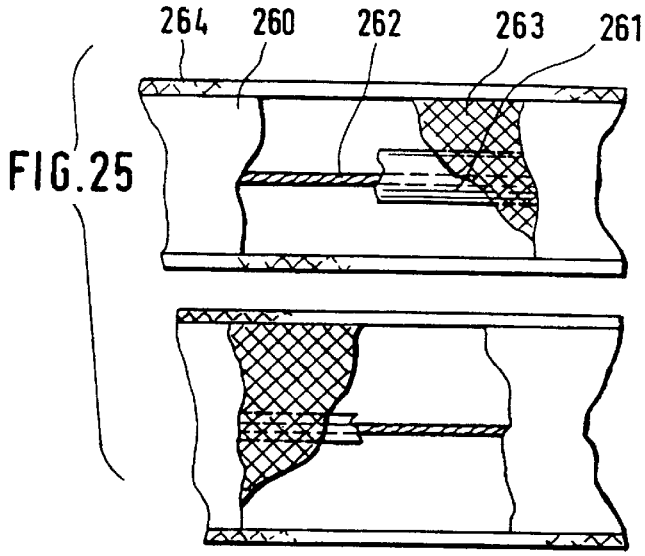
FIG.25
FIG.26
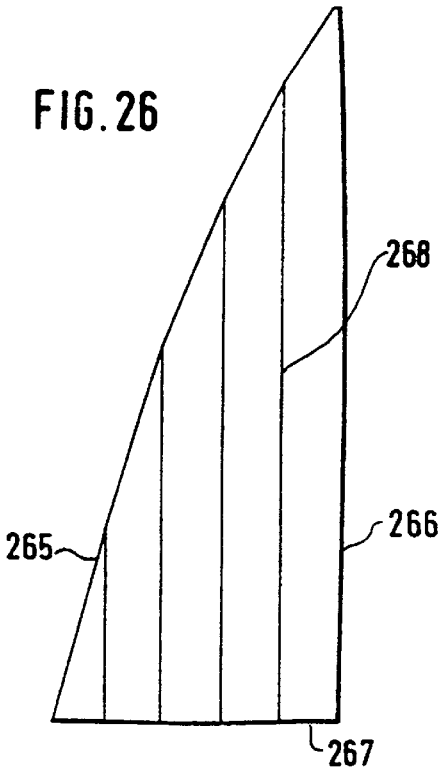
FIG.27
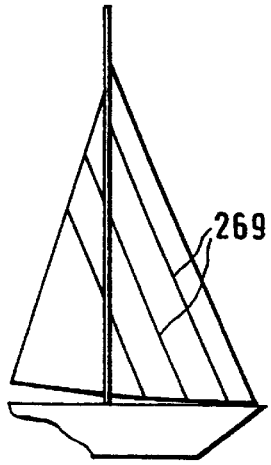

SAIL DEVICE

The present invention relates to an arrangement for a sail enabling its form to be varied and comprising battens extending between the fore-leech and the after-leech.

The sail is influenced directly by the wind when sailing, which gives rise to pressure of varying magnitude on the surface of the sail. The heeling of the craft results in displacement of the keel from its vertical line, and the position of the crew on board also influences the sail so that the pressure upon it increases as the craft increases its heeling. So-called battens are generally used to stiffen sail, and previously disclosed battens consist of horizontal strips of plastic or wood which are flexible in an essentially horizontal direction when the sail in question is supported by a mast on the craft. These previously disclosed battens exhibit an even form viewed in a vertical direction along horizontal inelastic channels in the sail, into which the battens have been inserted from the edge of the sail. The battens are allowed to flex and adjust the sail to the intended form in a lateral sense, although when viewed in a vertical direction the sail is not so arranged as to be capable of altering its form, even if this would be desirable in order to increase the effect of the sail on desired occasions when tacking between different winds or when the sail is subjected to some other influence.

U.S. Pat. No. 5,146,864

This patent is restricted to masts that are without shrouds and is restricted as such to surfboards or a small number of special boats.

Concerning the increase in the effect provided by this patent, this is only dependent on a commonly occurring front ampleness in the form of the sail, whereas the other technical details do not influence the effect in any respect other than they entail friction and an increase in weight.

In consideration of the ability of this patent to withstand deformation and wear, a change occurs here when the sailboard changes tack.

When changing tack, the spring embodied in this patent can remove the curvature of the sail and become compressed in a horizontal sense.

Figure 3:
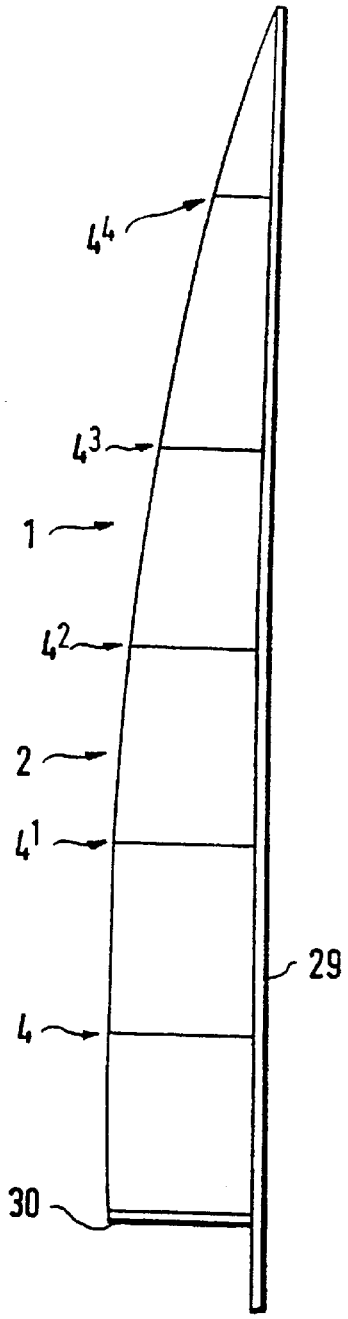

When changing tack, the curved profile will disappear, FIG. 3, with the consequence that it is lying in the direction of the wind for about a second and is not subjected due to the compression of the spring.

This spring mechanism is active for between 0.5 and 1% of the active part of the voyage and as such influences the wear for between 0.5 and 1% of the time.

It should be pointed out that this patent cannot use its spring to change the aerodynamic or three-dimensional form of the sail.

This patent is a static construction with the exception that, when the form of the sail changes side (change in tack), it relieves compression loadings of the battens on the spring.

The principal object of the present invention is, therefore, in the first instance to solve the aforementioned problem by simple and efficiently functioning means.

Said object is achieved by means of an arrangement in accordance with the present invention, which is characterized essentially in that the sail is divided into parts and is formed from a number of segments, with connecting devices situated between the segments acting as battens which extend in an elastic fashion across the longitudinal extent of the connecting devices.

This proposal is inspired by organic life forms and the everyday solution of aerodynamic problem in wing profiles.

The proposal is extremely variable and flexible and is exceptionally easy to handle and hard-wearing.

The proposal permits a considerably higher effect under varying conditions and permits extremely simplified handling during that period.

The proposal permits simplified manufacturing both at the design stage and in the workshop.

The proposal permits a more effective form for types of boats and rigs.

The proposal involves a choice of considerably cheaper materials.

The proposal has an incomparable capacity to withstand shock-loads and wear.

The proposal is superior with regard to the simplification of repairs and maintenance.

The battens, which are positioned in pairs, can be two in number for a small sail and up to six in number for a large sail.

The fact that the sail consists of detachable segments permits the simple replacement of segments for the installation of advertising or decoration.

This simple technical solution is completely concealed and gives the sail an attractive, traditional appearance.

COMMON BACKGROUND

The following is a brief description of the background to the development of the present invention.

Perhaps the most difficult aspect of this area is to create a sailboat concept that is efficient when heeling from 0–25 degrees and in the most varying wave resistance at these heeling angles.

The primary problem of how to take advantage of the self-righting power of the keel, but without forfeiting its hydrodynamic properties, is also encountered at these varying heeling angles.

Today's designers are naturally obliged to give very careful consideration to whether these fundamental forces can create the most favourable synthesis with the multiplicity of other parameters, and in the majority of cases they usually produce a design that reaches its ideal heeling at an early point in the wind register.

We must now address the sensitive problem of a design which reaches its ideal heeling at an early stage, but which is subsequently exposed to wind velocities capable of reaching such high levels that they have a devastating effect on all known designs.

We can now observe the actual results of these severe problems in the market, and we can see that today's materials are very extreme and were originally developed within the space industry.

The space materials of today have enormous properties when exposed to the specifically envisaged loads, but they lose these properties in the face of varying or random loads.

The construction of a sailing boat differs fundamentally from that of most other high-technology means of transport in the sense that it lacks an energy input that is capable of being influenced directly, and one is very probably obliged to take account of the fact that it is supplied continuously with new energy from the surroundings.

This surrounding potential energy is extremely rich in variation and is capable, like all other energy, of producing a devastating effect in the absence of an understanding how to control its inherent unique properties from outside, and the problem is complicated considerably when these properties must be harnessed and harmonized to a very sensitive human devices.

This variation-rich energy has until now been controlled in the majority of designs by the use of extremely static materials, in which this static character has been capable of variation to some extent by human influence.

The fundamental character of the designs has nevertheless remained static in the face of the variation-rich energy-flow, with the consequence that the majority of the potential energy sources have passed the craft with incomplete efficiency.

The unavoidable consequence of this knowledge and experience is the quest for a material and a design which conform as closely as possible to these variation-rich force-flows and which, through their flexible and sensitive nature, allow these forces to act freely without causing unexpected material failure through static brittleness.

The following problem now arises with regard to how to determine the limits within which this new material should be dynamic, and what parameters influence its dynamic properties.

These problems are so complex, when combined, that it is extremely difficult to produce a useful summary for an overall solution.

One possible way to address these problems is to examine living organisms and to establish how the constraints of evolution have caused them to adapt dynamically in accordance with this complicated network of different forces.

Closer examination of these organisms reveals that they resist forces not only through their dynamic features, but that they can also go beyond their maximum dynamic limits and thereafter make a sacrifice which involves forfeiting a proportion of their organic material to the advantage of their global potential and life-force.

The organism, which is subordinate to evolution's often secret but all-powerful meaning, is replaced in the present invention by inorganic substances in intimately interplay with human consciousness.

In this complex interplay between the hull of a boat and its sail area, the proposed invention changes the requirements for the relationship of both to aerodynamics and hydrodynamics, not simply by achieving a variable and dynamic sail area, and it is also concerned, to at least the same high degree, to permit the boat hull to be used more exactly and for a longer period close to the ideal values which constitute the character of the design.

TRADITIONAL SAIL TECHNOLOGY

When using a particular design of sail, one naturally seeks to extract the greatest possible forward driving energy from it.

Any the gain in this forward driving energy is unavoidably associated with laterally and rearward directed energy.

Due to aerodynamic laws, it is not possible here to distinguish the links between these directions of force, and it is necessary at all times to assume that they act simultaneously.

Since it is the boat's self-righting moment that makes it possible to obtain and determine the magnitude of the aerodynamically extracted energy through the three-dimensional form of the sail, it is of fundamental importance for all force directions other than the forward-directed force direction to be capable of being restrained.

An awareness of these misdirected forces has traditionally led to the development of a number of methods which permit practical adjustments to be made to influence the three-dimensional form of the sail, thereby increasing to some extent the register within which it is efficient.

In view of the large number of methods for practical adjustment, and the fact that they interact intimately with one other, it is appropriate at this point to mention only those which constitute the basis for a traditional change in form.

The method that involves forming a fold in the front parts of the sail, i.e. horizontal gathering of the front half of the sail, is used in lighter winds and involves an increase in the whole force-field, but suffers from the disadvantage of being a very blunt and turbulent tool.

Another method that is used in rather stronger winds involves stretching the sail material beyond its static values in order to reduce the aerodynamic force-field and in so doing to maintain a balance with the self-righting moment of the boat.

This stretching causes many negative consequences, the worst of which is the associated reduction in the life of the sail, frequently by about 90 percent when it is used to achieve a high performance.

PRACTICAL STRENGTH

The core of the problem touched upon here can most easily be appreciated by considering the design of a boat that lies moored to a fixed bridge or pier.

When examining different fittings, it soon becomes clear that these should be provided with an elastic capability in order to obtain the required strength and comfort.

By tradition, it becomes evident that a great variety of springs has been developed, which make it possible to moor boats at places where they would otherwise risk foundering.

The fact that this obvious solution has not attracted any further development, and has not proceeded beyond these moorings, is explained by the fact that other loads in the area of boating activity are very often associated with an effect take-off where this elastic effect would be difficult to synchronize exactly to energy sources which constantly vary in their strength and direction.

The other technical solutions accordingly respond to these forces with a very high static strength and instead depend on the gently damping properties of the water taking effect before this static strength collapses.

As a rule, the viscously damping properties of the water occur rather slowly, with the result that the material has already been exposed to loadings which exceed its elastic capability and cause permanent damage and deformation.

As far as the surface of the sail is concerned, this damage is essentially of an everyday nature and occurs to all intents and purposes immediately during active use.

It should be pointed out forcefully, therefore, that while today's sail surface is characterized by this brittle struggle with the associated reduction in the life of the sail, these previously deforming loadings now constitute the actual peaks of the energy source for the proposed invention.

Finally, the bending properties of the mast are most often used in conjunction with the aforementioned stretching method, and a small part of the sail's three-dimensional form at the front is influenced by this interaction.

This bending action has the very negative consequence of removing the forward-facing properties of the aerodynamic force-field significantly more than the other force directions.

Whereas traditional sail technology is characterized by the aforementioned frustrating efforts in this compromise-filled and highly weakening struggle against excessively strong deforming forces, the same forces for the proposed invention constitute the real source for the three-dimensionally and automatically aerodynamic refinement of the form.

APPEARANCE AND HANDLING

The present invention fundamentally changes the earlier needs to be able to influence the area of the sail and achieves this by variably and dynamically changing the three-dimensional form of the parts that are responsible for the size of the aerodynamically extracted energy and thus the majority of all the force that is the cause of the heeling (rolling) by a sailing boat.

When applied to established and traditional boats, the proposed invention changes neither the appearance nor the equipment, but performs functions such as increasing comfort, safety, material service life, economy and performance.

Because the traditional boats have a considerable need for comfort, the present invention provides a new opportunity to decrease the sail area (reefing).

This reduction in area is reminiscent of the traditional roller reefing method, but differs from this neither by influencing the three-dimensional form negatively nor by causing any other deformation of the sail material.

The possibility offered by this new method for a reduction in area consist of the proposed invention dividing the sail into simply dismantlable segments, where complete and direct separation can be achieved with a few simple manual operations.

By means of this separation, a chosen part of the sail can be rolled in around a commonly occurring core which is concealed inside the boom profile, while the remaining sail area is neither influenced negatively aerodynamically nor exposed to any deformations.

In those cases in which this rotating core inside the boom profile is missing, the sail can, of course, be reefed in any traditional way, if necessary.

Figure 1:
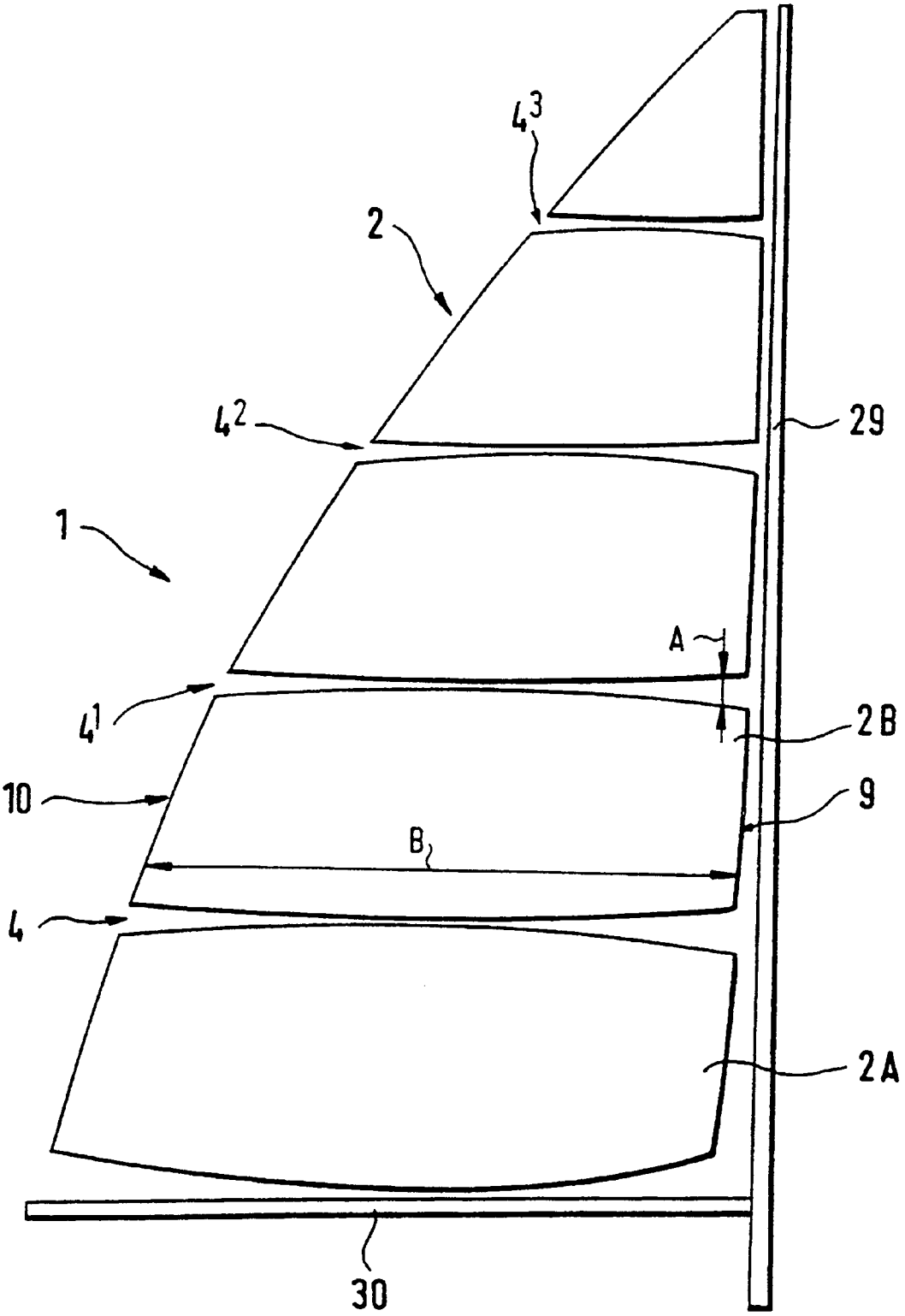
Figure 2:
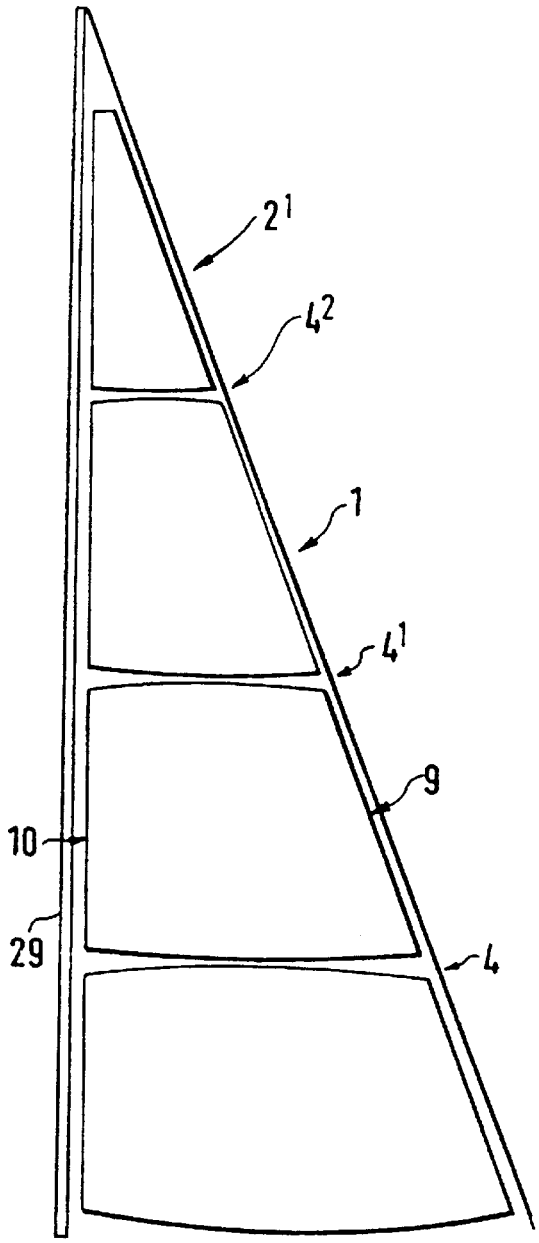
Figure 6:
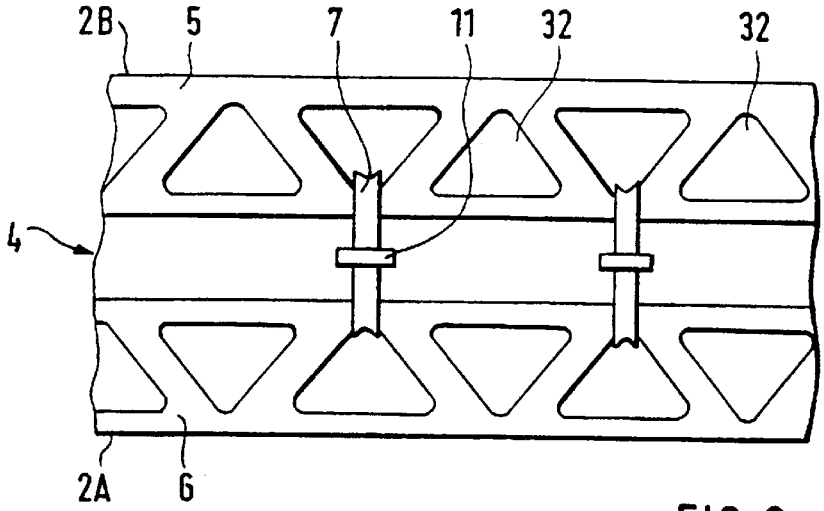
Figure 7:
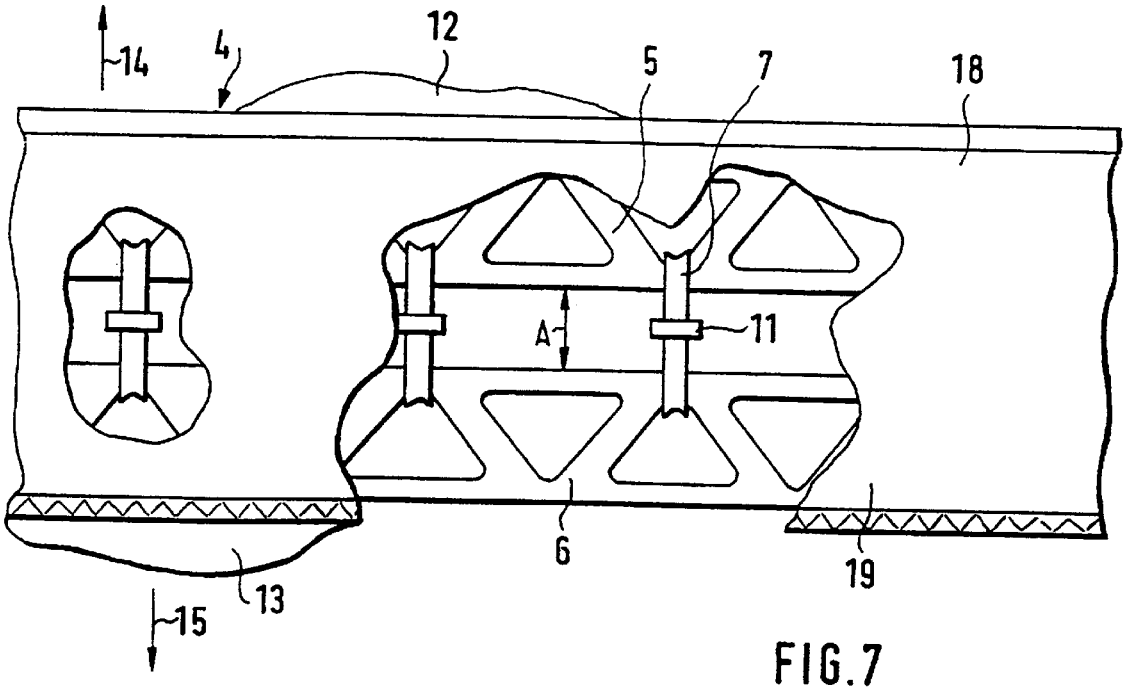
Figure 8:
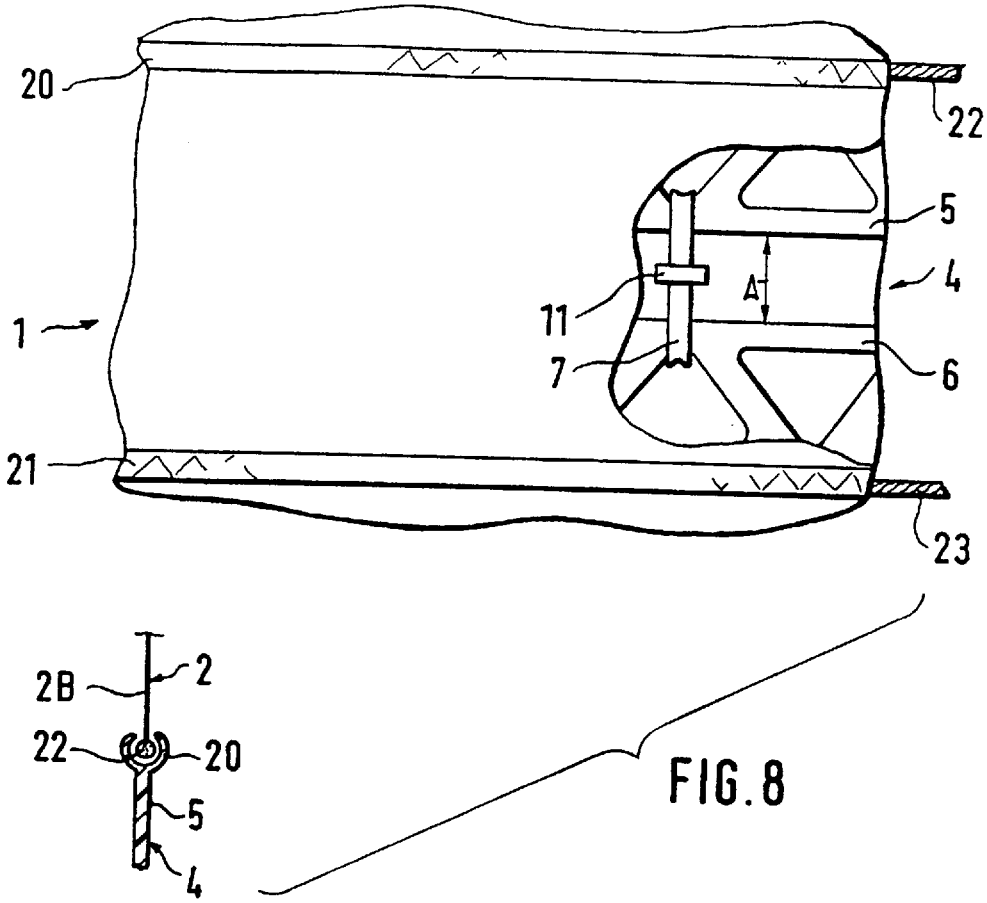
Figure 9:
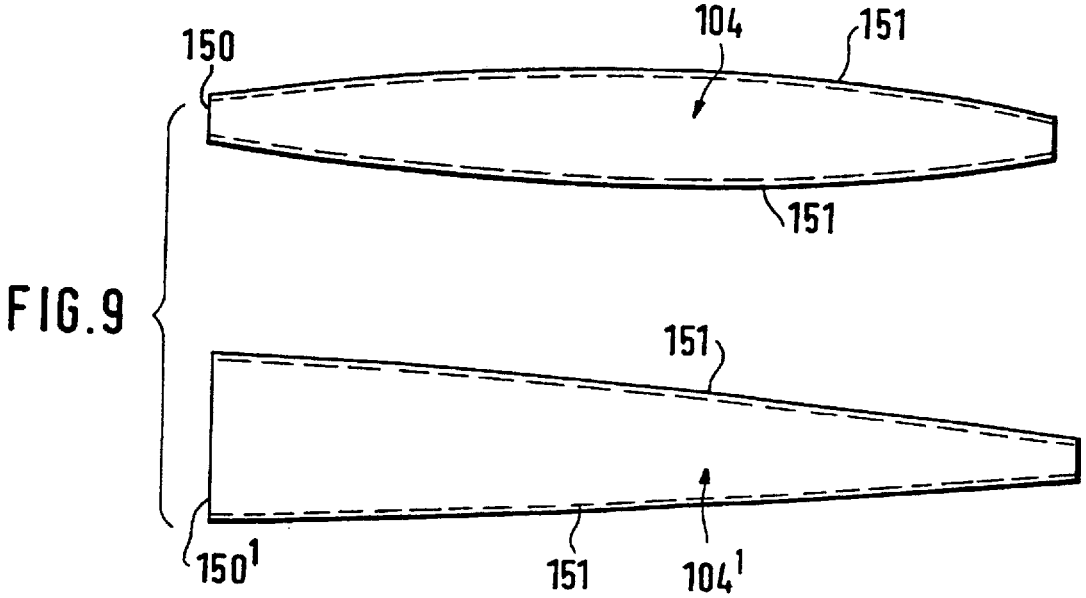
Figure 10:
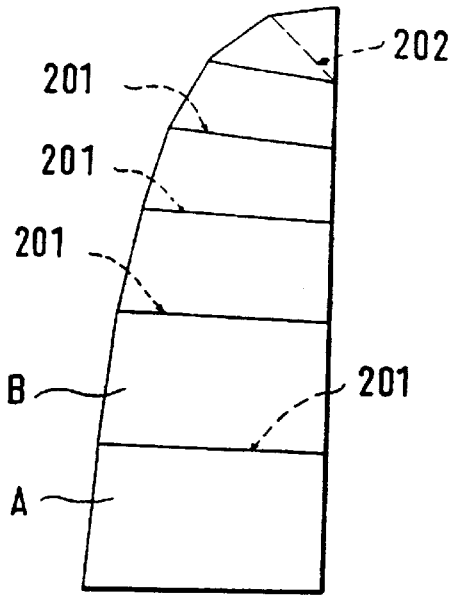
Figure 11:
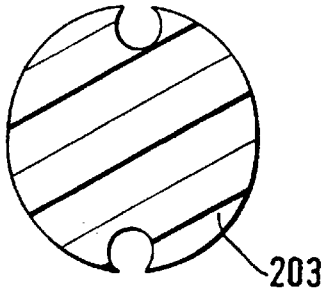
Figure 12:
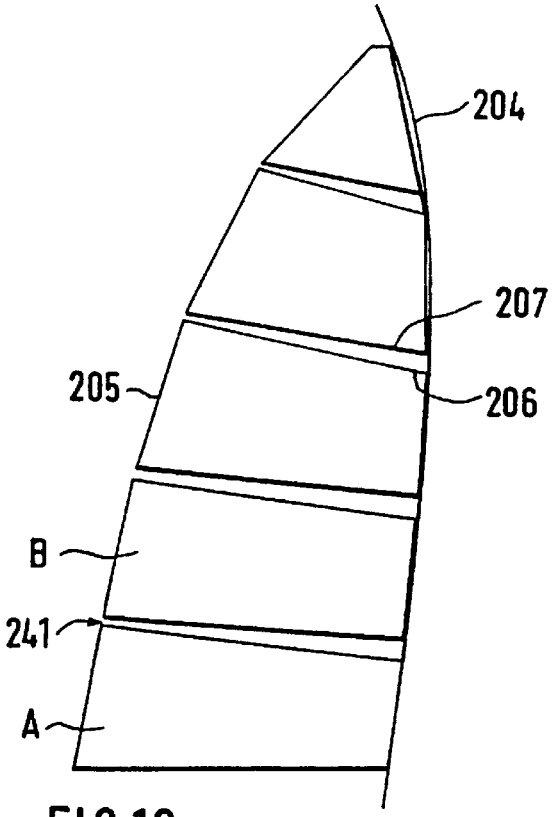
Figure 13:
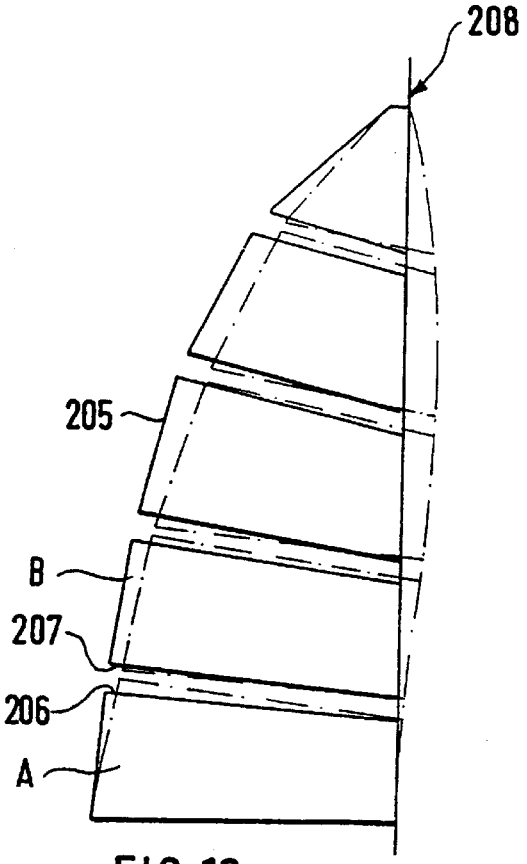
Figure 17:
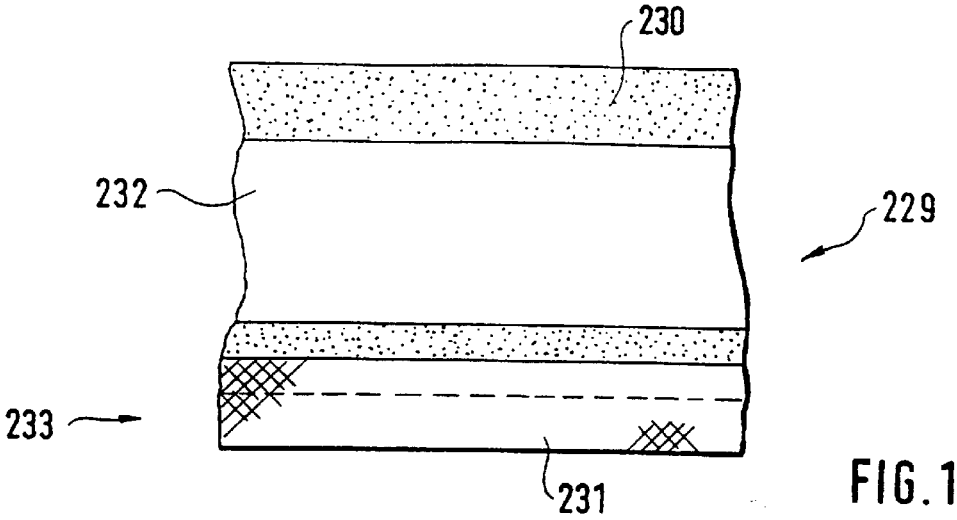
Figure 18:
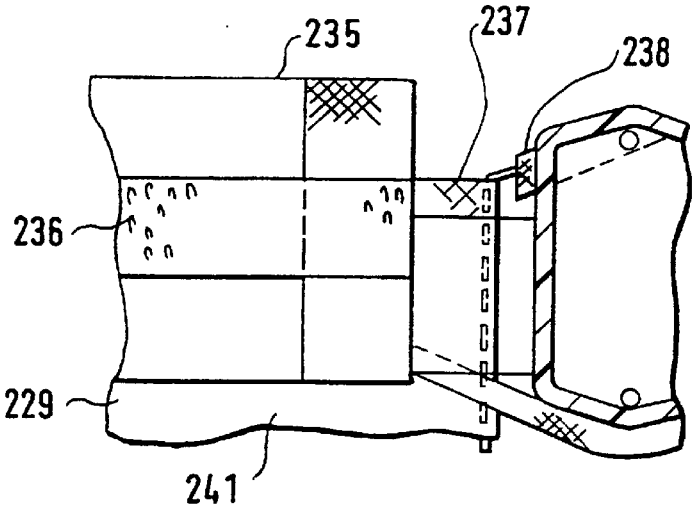
Figure 19:
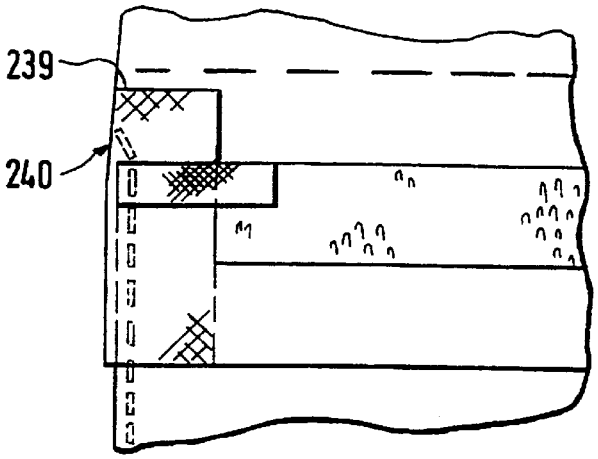
Figure 28:
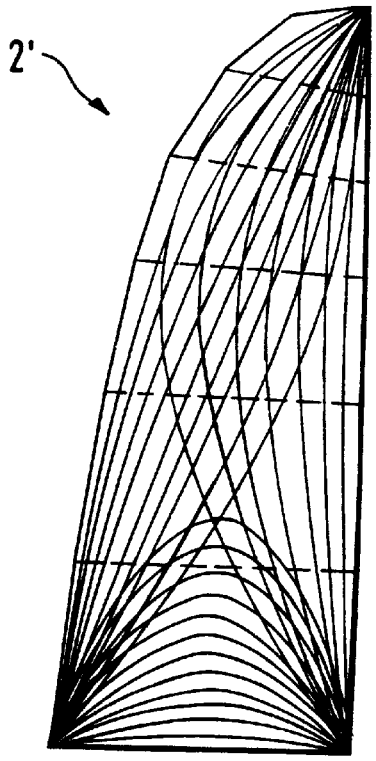
Figure 29:
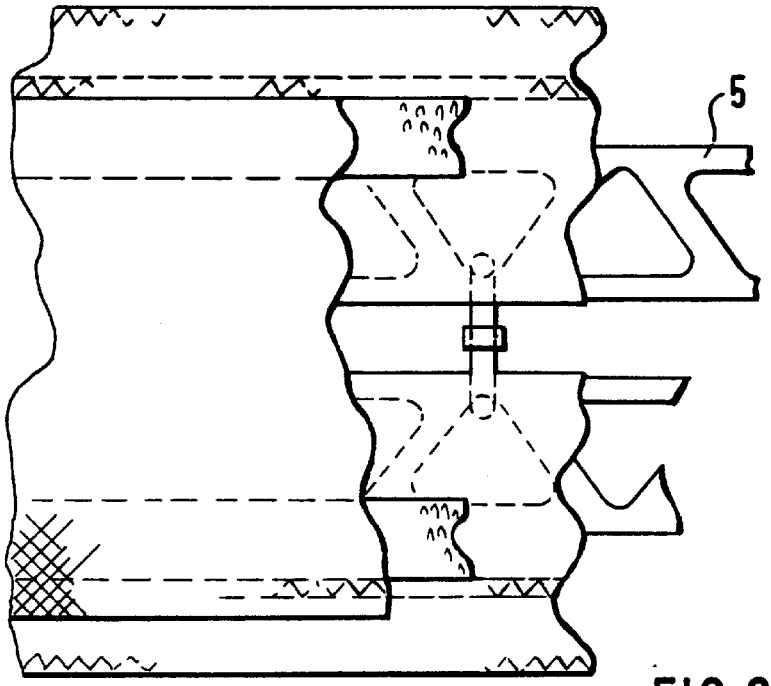

The invention is described below as a number of preferred illustrative embodiments with reference to the accompanying drawings, in which FIG. 1 shows a side view of a mainsail with the invention applied thereto, FIG. 2 shows a side view of a foresail with the invention also applied thereto, FIG. 3 shows a front view of the mainsail, FIG. 4 shows a first illustrative embodiment of the invention in detail in an active sailing situation, FIG. 5 shows schematically a view of the sail from above in a light wind, FIG. 5A shows the sail and its cross-sectional profile horizontally in a strong wind, FIG. 6 shows in detail a part of a batten in accordance with the second illustrative embodiment, FIG. 7 shows a further example of a batten, FIG. 8 shows yet another example of a batten, FIG. 9 finally shows a last example of battens in accordance with the present invention, FIG. 10 shows a further example of a sail incorporating the inventions, FIG. 11 shows a cross sectional profile of a connecting loop, FIGS. 12 and 13 show examples of a sail to which the invention is applied in a light wind and in a strong wind respectively, FIGS. 14 and 14A show examples of batten fittings, FIG. 15 shows a batten at the after-leech of a sail, FIG. 16 shows the reinforcement of a batten pocket at the after-leech of a sail, FIG. 17 shows an example of a highly flexible covering between the sail segments, FIG. 18 shows the finishing of the covering on the fore-leech, FIG. 19 shows the finishing of the covering on the after-leech, FIG. 20 shows an example of lattice battens and their connections to one other, FIGS. 21 and 22 show a batten pocket with different battens inserted therein, FIG. 23 shows a variant of compressible batten, FIG. 24 shows an example of a variant of a sail with a connection that is partially flexible, FIG. 25 shows a contracted batten pocket in a lighter wind and an uncontracted batten pocket in a strong wind respectively, FIG. 26 shows examples of vertical battens and connections, FIG. 27 shows examples of angled battens, FIG. 28 shows examples of a fully flexible sail, and FIG. 29 shows examples of a modified connection with battens.

An arrangement 1 for a sail 2 and $\mathbf{2}^1$ enabling its aerodynamic form to be varied comprises a number of battens 4–$\mathbf{4}^4$ extending between the fore-leech and the after-leech of the sail 2, $\mathbf{2}^1$ in question. In accordance with the present invention, the form of the battens 4–$\mathbf{4}^4$ is so arranged as to be capable of being varied depending on the wind and the desired form of the sail. This is made possible by the fact that the sail is divided and is formed from a number of segments (2A, 2A, . . . etc.) with connecting devices situated between the segments acting as battens which extend in an elastic fashion across the longitudinal extension of the connecting devices.

In accordance with a first illustrative embodiment of the invention, a batten 4 is divided and is formed from two batten parts 5, 6. Arranged between the aforementioned batten parts 5, 6 is a number of devices 7 which are arranged for adjustment of the distance A between them. The aforementioned distance A can be arranged for adjustment with varying values along the battens 4, or with equal distances.

The aforementioned distance adjustment device is preferably formed from elastic devices 7, e.g. bands of elastic material which are preferably so arranged as to extend vertically 8 between the aforementioned batten parts 5, 6 which bridge the distance B between the fore-leech 9 and the after-leech 10 of the sail. Adjustment of the distance A between the batten parts 5, 6 is permitted in this way, for example by vertically 8 acting elastic bands 7 and elastic band locks 11 for locking them in the desired position. The question may also arise of a single elongated elastic device extending, for example, along the boom of the boat, for instance in the form of a wound rubber band or a rubber cloth, etc. See, for example, FIG. 20, where an inelastic band 200 extends between links in such a way as to permit adjustment of the distance between the batten parts.

The battens 4 may, for example, be so arranged in a previously disclosed fashion as to be capable of being inserted into horizontal batten pockets 18, 19 in the sail, formed from folded parts of the sail.

The upper batten part 5 and the lower batten part 6 in a batten 4 are each capable of attachment to their respective part of the sail 12 and 13 along the horizontal upper side 16 and lower side 17 of the batten parts 5, 6 facing in a direction away from one other 14 and 15.

By way of example the attachment of the sail to the batten 4 can be achieved by means of thickened tracks 20, 21 arranged in the respective batten part 5, 6, and which are so arranged as to be received respectively in a channel-shaped bottom edge part 22 and an upper edge part 23, each in its own part 2B and 2A, etc., of the sail, which are designated as sail segments, and one leech rope 24, 25 capable of being inserted therein and detachable from the end 20A, 21A of the tracks 20,21.

The aforementioned batten parts 5, 6 are suitably so arranged as to be formed from lattice constructions which are preferably compression-moulded in plastic material. See also as an example FIG. 14A.

Each batten is so arranged as to be covered by means of a highly elastic covering cloth 26, part of which is shown in the drawings in FIG. 7 with cut-aways to show design and construction of the batten. This provides a uniform transition between the parts of the sail to form a common uniform sail area.

Velcro fasteners 27, 28 are suitably located on the upper and lower batten parts 5, 6 to make possible the detachable attachment of the covering cloth 26 to batten 4 and the adjacent parts of the sail 12, 13, etc., in order to obtain the whole sail as a wind-receiving area.

Through the aforementioned sail arrangement 1, an aerodynamic form is integrated in a static manner in a normal sail 2, $2^1$ for boats and other sailing craft. The arrangement in accordance with the invention is now positioned at the places where the form was previously integrated in horizontal lines and curves.

The function of the arrangement can be appreciated in FIG. 3 by considering a mainsail 2 from the front in lighter winds, extending from the mast 29 and the boom 30 with the sail contracted. In stronger winds, the previous angularity of the sail will disappear as a result of the expansion of the sail thanks to the ability of the battens to grow vertically.

FIGS. 5 and 5A show the form of the sail seen from above with the sail extending from a mast 29, in conjunction with which the small curve shows the sail in a strong wind, FIG. 5, and the larger curve shows the sail 2 in a light wind, FIG. 5A. In light winds, the elastic band 7 in the battens will be in the main unaffected, whereas in stronger winds the aforementioned elastic bands 7, which are located further back towards the after-leech 10, will stretch and increase by 1–1.5% viewed in relation to the total sail curve 31 of the sail.

By executing the battens 4 as lattice constructions, as shown in FIG. 6, for example, the number of elastic bands 7 can be reduced considerably. In this way, most of the lattice holes 32 will be empty and will not receive any elastic band, and will instead have a stiffening effect. The aforementioned stiffness prevents deformation of the superjacent and subjacent sail cloth 2B, 2A . . . .

In the construction of a batten 4 shown in FIG. 8, a track 20 and 21 with a diameter of ca. 3 mm is positioned respectively on the upper and lower edge of the upper and lower batten parts 5 and 6. In this way, the battens 4 and the sail 2, $2^1$ can be connected together by the fact that the sail has a 2.5 mm thick leech rope 22 and 23 attached to the edge of the sail, which rope can easily be inserted into and withdrawn from its receiving tracks 20, 21 in the batten 4. The elastic part 7 of the batten can be replaced, for example, with an adjustable inelastic construction, for example a hydraulic compressor mechanism, etc., which mechanically adjusts the distance A.

There is also one further solution for a batten which solves the problem in accordance with the above. This variant consists of battens 104, $104^1$ with different forms, which are threads onto the parts of the sail when different wind velocities prevail. The form of the battens varies by ca. 1–1.5% in this case, too, calculated in relation to its length. These battens 104, $104^1$ must be executed with great accuracy, with a rear end 150, $150^1$ on the strong wind batten $104^1$ that is only a few centimeters wider than that of the light wind batten 104. This variant of a batten is very simple but effective, and the form of the battens must be executed accurately. Today's sailors are thus able to change the battens and obtain different functions from the same sail to suit different kinds of winds.

A track 151 on the upper and lower edges of the battens in this way provides a connection for the top and bottom edges of the sail permitting attachment in a simple fashion.

The covering elastic part for every batten can be dispensed with in this way.

Sailing Race Optimization

In those cases in which the present invention is used in competitive sailing races, it offers a number of visible and practical changes.

The most radical of these changes is that the dynamic character of the invention has dispensed with the need for a permanently fixed after-stay, which has provided free space to broaden the mainsail, in particular in its higher regions.

The strength lost by the removal of this permanently fixed after-stay is compensated by the fact that the side-stays of the mast (shrouds) are angled rearwards, and that their fittings are positioned in the angle of deflection between the hull and the deck.

Since the rigging strength that was lost by the removal of the permanently fixed after-stay cannot be fully compensated for by rearward-angled shrouds and their attachments, the possibility must still remain to use a simply dismantlable after-stay.

This removable after-stay, which is only intended to provide security under extremely arduous conditions, is used in conjunction with the main sail being reefed.

This change in the staying of the mast has provided the foresail with a new restriction in its size, which nevertheless harmonizes well with the fact that the proposed invention is not sufficiently flexible in the horizontal direction to enable it to overlap easily and at the same time pass in front of the mast.

It is probable that competitive racing yachtsmen will have an interest in using the segmented dismantlable capability of the invention by replacing selected parts, so that they can go to extreme lengths to meet all the demands of the sport.

FIG. 10 shows a sail with segment connections 201 and a stabiliser 202, which by its nature is a strong batten that is intended to withstand the high vertical forces.

Pressed Lattice Battens

The lattice form is obviously ideal for the large vertical forces, although the clearly increased flexibility in the horizontal direction is also excellent since the demanded aerodynamic form is directly dependent on this sensitivity.

The dimensions of these lattices are for many reasons mostly dependent on the size of the sail area and can, in very demanding cases, call for a vertical height of about 15 cm, whereas a very small sail can manage with about 1.5 cm.

These lattice battens can be provided with tracks on one or both of their edges, depending on which method is selected or it is wished to combine.

When selecting the tracks on both edges, the highly flexible covering with its associated Velcro fasteners can be replaced by insertable strips in either a flexible material or ordinary sailcloth, and in both cases it is naturally advantageous to have a wide range of forms and stability for immediate adjustment depending on external circumstances.

Variations in the Segments

Since boat designs have sailing-specific technical needs that are unique to their concept, the character of the segments will be highly dependent on these circumstances.

Since some boat designs are based on a concept which means that their heeling angle should not exceed 25 degrees, whereas others should not exceed 15 degrees, there will accordingly be a difference in the angle at which the wind will meet the lines of the segments on the surface of the sail.

Other reasons for a varied angle of the segments are the height-to-width ratio of the sail and the associated change in the angle of the rearmost line of the sail (after-leech).

These segments should be considered as horizontal for practical reasons, but in view the varying concept of these boat designs, the segment angles can differ and increase by about 30 degrees from the horizontal plane.

As far as the number of segments is concerned, the question is rather one of the size of the surface of the sail, and in those cases in which the size is obvious, the number of segments can exceed 10, whereas if the sail is very small the number can be reduced to around 2 segments.

Additions

With this addition, the need for the previously proposed pressed lattice battens disappears. By using the present addition, the aforementioned battens can be replaced by extremely minimal loops which, by their nature, do not depend on any stability other than sufficient strength enabling them to form a secure grip around the sail material in question.

The appearance and function are unchanged compared with the previously proposed invention, with the exception of these minimal loops, which no longer have any need for any elastic band connections or highly flexible covers, but instead are only replaced by insertable flexible strips of varying form and stability, or also by strips of varying form and stability made of ordinary sail material; see FIG. 11.

Naturally, the flexible nature of these loops 203 can be changed to perform more of a function as stabilizing battens.

Mast Curve (Light Wind)

The intention here is to make the construction as compact as possible without losing the necessary variable capability. FIG. 12 shows the sail with a mast curve 204 and the different segments A, B, . . . etc., of the sail.

It can be seen how the segments A, B are angled towards one other at the after-leech between the top and bottom edges 206, 207 of the segments.

Mast Curve (Strong Wind)

FIG. 13 shows two cutting-out patterns, which are integrated in the same sail. These two patterns can be imagined as extremities of the same sail, in the position that it will occupy during normal conditions and will vary in a flexible fashion between these two extremities, in conjunction with which the mast curve 208 is shown straight and curved respectively. It can be seen here how the segments A, B in the after-leech 205 are angled away from one other. The top and bottom edges 206, 207 of the segment are shown to be straight.

Batten Fittings

Examples of batten fittings are shown in FIGS. 14 and 14A together with reinforcements 209, one of which should be in at least two layers. A strong and shrink-proof leech rope 210 extends along the sail. A woven webbing strip 211 is mounted on the outside of the intended batten pocket. Plastic fittings 212 receive the battens 213, 214, but in the upper part of the sail the fittings will form a sharp angle with the mast. This sharp angle will chafe against the woven webbing strip 215 that passes through at this point, unless the channel 216 for the fittings is filed to achieve a round form after the mast line.

A shackle 217 connects the parts to one other. 218 designates an over-folded webbing strip, and 219 a batten pocket which is double and equilateral.

FIG. 14A shows battens 213$^1$, 214$^1$ of lattice construction.

Batten (After-leech)

FIG. 15 shows the rear part of the battens when the distance between the segments has increased in a rather stronger wind.

220 designates reinforcements, and 221 designates the outermost edge of the batten pocket. The double-sided purse lines must be brought to this point and terminated. 222 constitutes a woven double webbing strip which is externally equilateral. Normal and accepted adjustment of the batten 224 takes place in the batten pocket 223 formed with both double and equilateral reinforcements lying externally.

Reinforcement (After-leech)

FIG. 16 shows the aforementioned reinforcement, and the whole reinforcement 225 will be folded double to create a supporting bed for all the battens and should have less cloth weight than the others.

The batten pocket 226 is formed internally from reinforcements 225. The Velcro tape in the form of hard male component 227 lies outside everything else, and a woven webbing strip 228 (wearing bed for the batten) lies inside everything else.

The reinforcement 225 must not be to hard, and judgement must be applied when determining the number of layers, the weight of the cloth and the hardness, in order to create a flexible and strong solution.

The outermost seams on the Velcro tape 227 can be sewn at the same time as the seam that connects the batten packet to the sail segment.

Flexible Cloth

FIG. 17 shows a highly flexible covering, and the proposal is neoprene that is 1.5 mm thick and covered with a nylon covering.

This flexible cloth 229 is of uniform with for its entire length, but will at all times be placed under varying tension which causes its width to change.

On its fore-leech, the flexible cloth will always be tensioned with one or more mm of its elasticity. At the after-leech, the tension in lighter winds is 0 cm, while in stronger winds it will expand with between 1–1.5% of the total length of the sail profile. In this context, an attempt has been made to prevent baggy deformation as a result of the wind pressure.

The flexible cloth 229 comprises an upper Velcro tape 230 (female component) with a superjacent flexible cloth that is naturally folded under itself in order to avoid fraying and ripping.

A lower Velcro tape 231 (male component), which is attached to the flex cloth 229 last of all, is sewn partially to the visible flexible cloth 232 and partially to the gripping cloth 233.

The gripping cloth 233 lies freely for rapid adjustment and consists of a double-folded 5 cm strip which has the flexible cloth inserted into it and grips over it. 223 designates the working part of the flexible cloth, and 229 and 234 designate the visible part of the flexible cloth. The visible part of the gripping cloth has the flexible cloth secured between its double-folded layers.

It is possible that the grip here can be reduced to 1 cm by double-folding a 4 cm strip instead of the previously proposed 5 cm strip.

Flexible Cloth (Terminations)

The top parts of FIGS. 18 and 19 show the termination of the flexible cloth 229 on the mast luff, while the lower parts of these Figures show the termination of the flexible cloth on the after-leech. 235 designates the upper edge of the batten pocket with a Velcro tape 236 concealed under a flexible cloth 229. A woven webbing strip 237 overlaps behind the Velcro tape 236. A woven strip 238 is attached to a bolt under the bevelled (plastic fitting).

FIG. 19 shows a woven webbing strip 239, and a rubber cord 240 which consists of rope is displayed when it deflects over the webbing 237. This prevents chafing.

A double-folded channel 241 is formed in the flexible cloth and is folded behind and overlaps the Velcro tape 236.

The attachment of this to the after-leech and its possible connection to the purse lines is something that can be solved in many ways.

Mast Curve (Light Wind)

FIGS. 12 and 13 show the mast curve, although these must be regarded as rough everyday examples. The distance 241 between the segments A, B, etc., is shown exaggerated and the same distance must be exhibited here on both sides; i.e. the lines must be parallel.

Note also that the mast curve of the sail is shown, while the forward mast is straight.

Mast Curve (Strong Wind)

It can be seen here how the sail works at different wind velocities. The mast will be curved by natural loadings in stronger winds, which is not shown here.

FIG. 14A shows the batten fittings of the mast luff as variants.

Optimizing Combinations

The self-righting moment is a very reliable parameter for verifying the dynamic amplitudes of the proposed invention, but also suffers from the drawbacks of acting with sluggishness and having a complete inability to sense and apply the varying hull resistances of the craft.

These incomplete factors can be counteracted by an additional mechanical feature probably consisting of a means of line regulation, although a compressed air or hydraulic system can also be used where the requirements of strength and performance are vital.

This additional mechanical feature must harmonize with the elastic parts of the proposed invention by ensuring that these are not dimensioned to control 100% of the forces, but leave around 50–75% of the load at a small number of selected locations for mechanical adjustment.

The most important locations for this additional mechanical feature are situated in about 25–50% of the upper and after parts, where they receive the greatest effect over the force that contributes to the most significant lever-assisted influence on the self-righting moment of the craft.

The additional feature can, of course, be given a greater extent, but problems can then arise with unmanageable friction and an inappropriate increase in weight.

The problems associated with friction mean that the additional feature provided with a line should not pass over excessively large and curved surfaces, but should instead exhibit the greatest reliability when it is distributed in such a way that its extent and the accompanying extension for adjustment follow the shortest and straightest lines.

Additional compressed air or hydraulic features can, by avoiding the problems of friction, be given a greater extent, although their applications are probably a very restricted in view of the extremely high loadings encountered at elite levels in international sporting events.

The considerably more simple additional feature with a line can be very applicable because it can be used as a simple and nice contribution within sporting situations due to a choice of extremely strong lines of about 1 mm.

Variations in Technical Rules

The single-type classes that are commonly encountered within the sport of sailing are characterized by very strict rules which, in the majority of cases, make it impossible to use the proposed invention in its original embodiment.

Because of this, there are compelling reasons to vary and adapt the proposed invention, even if it loses some of its effect as a result of this change.

These strict class rules probably prohibit division into segments and the resulting pairs of battens with their associated highly flexible covers.

What can be used instead here are simple battens of the previously described type, where these are inserted into batten pockets of traditional appearance.

On the inner upper and lower edges of these batten pockets are thin strips which enclose approximately 2 mm thick ropes, in which the various battens, with their upper and lower channels, can be slid into position.

A higher effect can be obtained if these strips are elastic and are even broader than indicated in the drawings.

These drawings show the same batten pocket with two different battens inserted. See FIGS. 21 and 22.

FIG. 21 shows the batten pocket 250 in a rather lighter wind, which will be associated with some gusting, while FIG. 22 shows the batten pocket in a rather stronger wind.

An approximately 2 mm thick rope is received in the resulting batten pocket 250, and a strip enclosing the rope 251 can with advantage be elastic and broader where the rules so permit. The drawings show the after part of the battens with small variations due to the probable technical restrictions on size in the various classes.

Variation in Compression

It is possible to replace other batten constructions with a type which retains the greatest possible effect but achieves this with a significantly more compressed execution; see FIG. 23.

This model consists of pairs of battens 252, 253, which are laid with their flat sides facing one other, whereby they slide and move in a controlled fashion relative to one another by using the upper and lower edges both battens as an attachment for the elastic connections and are pivotable around a joint 254.

Because of the high friction that occurs when the flat sides of the battens are sliding against one another, the need probably arises to use a low-friction material between their contact surfaces.

Where they strict class rules permit, this model can also be used to be inserted in position as a replacement, where these are used together with the technical variation in the rules.

This model can also be used, as before, in conjunction with segmentation and a highly elastic covering.

Semi-flexible Combination

The advantages of this model are based on the fact that rigid, full-length battens are able to overlap and pass in front of the mast only with difficulty.

By allowing all the variations in the proposed invention a limitation of their extent to the rear parts of approx. 70%, the front 30% exhibits a completely traditional appearance which is also capable of being fully compressed in a fore-and-aft direction and in so doing permits an excessively wide sail to pass in front of the mast.

This model is especially suitable for foresails, although mainsails can also be considered where problems are encountered in passing in front of the after-stay.

It is likely that this model does not provide any advantage in permitting full segmentation and the possibility of separation, but that the front 30% in this case risk presenting an obstacle which makes the sail represent a non-dismantlable whole.

In those cases in which a high-performance Velcro tape is capable of withstanding the front forces, the sails can be dismantlable.

See FIG. 24, where 255 designates a mast, 256 the after-leech, 257 the flexible maximum limit, 258 the luff and 259 the stem.

Rotating Round Stick

This model is particularly suitable for single-class types, where it is capable with a minimal execution of performing the variable tasks within the limits of the strict class rules.

When the round stick is used in combination with compressed air, hydraulic or line regulation, a considerable effect can be achieved.

Where these combinations cannot be used, the active flexible dynamic is obtained instead by causing the round stick to rotate together with a well matched elastic material.

The shape of the round stick is highly dependent on the torsional resistance of its material, and both tapered and non-tapered shapes may be considered.

The diameter of the round stick can expand due to the fact that it a number of layers of flexible cloth are wound around it.

Illustrated at the top of FIG. 25 is a compressed batten packet 260 in a lighter wind, shown in the rear parts of the sail, and an uncompressed batten pocket, in a stronger wind, shown in the rear parts of the sail. This receives a round stick 261, which is so arranged as to roll up a flexible cloth 263 which is concealed internally within the batten pocket 260. On one of its long sides, the round stick 261 receives an approx. 2 mm broad webbing strip 262. The batten pocket 260 is bounded by seams 264.

Vertical Battens (Mainsail)

The vertical battens in the traditional and established embodiment enable the area of the sail to be reduced (reefing), or the sails to be stored by rotating them around a core which is usually concealed inside the mast profile.

The purpose of this established construction is to obtain a high level of convenience without failing to meet the performance requirements.

The loss in performance is unavoidable, since the vertical battens constitute turbulent obstacles and angles located precisely in the path along which the horizontal wind flow will pass.

If the proposed invention is used in a vertical embodiment as a replacement for the established vertical battens, it must be assumed that the turbulent obstacles will increase, even if the resulting aerodynamic effect is higher.

In its appearance and embodiment, the proposed invention is shown here without any major change other than the fact that it is now vertical instead horizontal as previously.

FIG. 26 shows a mainsail with an after-leech 265, a luff 266 and a foot 267, where vertical battens 268 follow the angle and line of the mast exactly.

Vertical Battens (Foresail)

As far as the foresails are concerned, essentially the same as for the foresail (Genua) applies, with the exception that they are wound around a profile on the fore-stay instead of inside the mast.

A large gain in area can be achieved here when the vertical battens do not obstruct the sail from overlapping and passing in front of the mast.

FIG. 27 shows a variation in the positioning of the batten, where the uneven division with battens 269 is intended to facilitate their passage and to provide concentration of the aerodynamic form where it is effective.

Fully-flexible Model

The advantages of this model are based on the fact that the compressive loadings of the wind are contained in such a way that the sail material, even under the most severe conditions, is never exposed to the risk of deformation.

What instead causes the deformations is the cumulative effect of compressive loadings, which, when they are propagated from the central parts of the sail, undergo a transformation into increasing tensile loadings.

The basic material of the model is given only sufficient strength to resist the very small compressive loadings, while the resulting tensile loadings are instead controlled by an additional construction.

This additional construction consists of flat channels in the sail's own material that extend from the loading points of the sail to meet the opposing loading points.

Inserted in these channels are adjustable elastic bands, which are synchronized to control the additional compressive loadings with the resulting tensile loadings; see FIG. 28.

Finally, FIG. 29 shows a modified model of battens and associated parts such as battens, batten pockets, flexible cloth, gripping cloth, Velcro tapes, webbing strips, webbing strip locks and seams.

Form-induced Effect of the Battens

Since the proposed invention with its segments exhibits a complete lack of static three-dimensional form, the aerodynamic form must by necessity be induces from other sources.

In this case, the source consists of the compressive force that the mast profile or the fore-stay exercises on the battens with their connections situated at the rear.

The reason for this compression force is that the fore-leech curves in the sail that are located behind exercise a force causing expansion in the horizontal direction, but which is restricted by the mast profile or fore-stay located at the front.

This restriction of the opportunity for the battens to expand in the horizontal direction results in the tensioned batten material instead seeking to expand in the horizontal plane. This expansion is possible, since the battens are enclosed or connected by elastic devices which, when subjected to this compressive force, permit the otherwise two-dimensional area to grow into a three-dimensional form.

By considering this expanded form in the horizontal plane, the result is that the vertical distance between the segments of the sail are noticeably larger at the centre of the sail profile than it is at the beginning and at the end, which for the most part remain unchanged.

This vertical differences in distance induced by the form will, in most cases, vary by between 0.4–0.7% of the total length of the profile of the sail.

It is of major importance for the stability of the selected battens in the horizontal plane to be in proportion to their length in the sail profile, since this stability is crucial for the intended aerodynamic form of the sail.

It should be pointed out that the aforementioned form-inducing effect of the battens stands in an intimate interaction with the more dominant wind-assisted refinement of the form.

The invention is not restricted to the illustrative examples described above and illustrated in the drawings, but may be modified within the scope of the Patent Claims without departing from the idea of invention.

What is claimed is:

1. A sail (2, 2$^1$) enabling its form to be varied and comprising battens (4–4$^4$; 104, 104$^1$) extending between the fore-leech (9) and the after-leech (10), characterized in that the sail is divided into parts and is formed from a number of segments (2A, 2B . . . ), said battens in the form of connecting devices situated between the segments which extend in an elastic fashion across the longitudinal extent of the connecting devices.

2. The sail as claimed in patent claim 1, characterized in that the aforementioned connecting devices are so arranged as to permit the division of the sail into dismantlable segments to achieve the desired size as the need arises.

3. The sail as claimed in claim 1, wherein the aforementioned connecting devices are so arranged as to extend horizontally or vertically along the straight lower leeches of the sail and the leeches facing towards the mast, or at an angle to these.

4. The sail as claimed in claim 1, wherein the aforementioned connecting devices are made of elastic cloth or loops, each of which is connected with its respective long sides to its associated sail segment, in so doing connecting these together to permit the elastic separation of pairs of sail segments that are held together by common connecting devices.

5. The sail as claimed in claim 1, wherein the aforementioned connecting devices form a part of a resulting batten pocket to receive a batten part.

6. The sail as claimed in patent claim 5, characterized in that a protective cover for the aforementioned batten pocket is made of parts provided with hook and loop fasteners.

7. The sail as claimed in patent claim 1, characterized in that the aforementioned batten (4–4$^4$) having upper and lower batten parts is divided with devices (7) between the batten parts (5, 6) for adjustment of the distance A between them.

8. The sail as claimed in patent claim 7, characterized in that the aforementioned distance adjustment devices are made of elastic devices (7) which extend vertically (8) between the batten parts (5, 6) which bridge the distance (B) between the fore-leech and after-leech (9,10) of the sail.

9. The sail as claimed in patent claim 8, characterized in that the adjustment of distance (A) between the batten parts (5, 6) is made possible by vertically acting elastic bands (7) and elastic band locks (11).

10. The sail as claimed in claim 1, wherein the battens (4–4$^4$) are inserted into horizontal batten pockets in the sail.

11. The sail as claimed in patent claim 1, characterized in that an upper batten part (5) and a lower batten part (6) in said batten (4) are each capable of being connectable to their associated part of the sail (2B and 2A) along the horizontal upper and lower sides (16, 17) of the upper and lower batten parts (5, 6) facing in a direction away from one other.

12. The sail as claimed in patent claim 11, characterized in that tracks (20, 21) in the respective batten part (5, 6) are each so arranged as to receive a bottom edge part (22) and a top edge part (23) in their associated part of the sail (2B and 2A) and a leech rope (24, 25) detachably insertable therein.

13. The sail as claimed in patent claim 1, characterized in that the batten parts (4) are formed from lattice constructions, preferably by compression moulding.

14. The sail as claimed in claim 1, wherein the respective batten (4–4$^4$) is so arranged as to be covered by a highly elastic covering cloth (26).

15. The sail as claimed in patent claim 14, characterized in that the hook and loop fasteners (27,28) are located on the upper and lower batten parts (5, 6) to make possible the detachable attachment of the covering cloth (26).

* * * * *